US007621784B2

(12) United States Patent
Ichimiya et al.

(10) Patent No.: US 7,621,784 B2
(45) Date of Patent: Nov. 24, 2009

(54) SOCKET CONTACT

(75) Inventors: Kuniaki Ichimiya, Kanagawa (JP); Shinichi Koga, Kanagawa (JP); Daichi Miyamoto, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 12/379,813

(22) Filed: Mar. 2, 2009

(65) Prior Publication Data

US 2009/0227143 A1 Sep. 10, 2009

(30) Foreign Application Priority Data

Mar. 4, 2008 (JP) ..... 2008-052871

(51) Int. Cl.
*H01R 24/00* (2006.01)

(52) U.S. Cl. ..... 439/676; 439/954; 439/957; 439/876

(58) Field of Classification Search ..... 439/378, 439/676, 789, 803, 822, 869, 874–876, 908, 439/954, 957
See application file for complete search history.

(56) References Cited

U.S. PATENT DOCUMENTS 3,340,497 A * 9/1967 Balint ..... 439/872
3,818,278 A * 6/1974 Adler ..... 361/767
6,341,982 B1 * 1/2002 Sakamoto et al. ..... 439/537
6,517,388 B1 * 2/2003 Croise et al. ..... 439/697
6,739,917 B2 * 5/2004 Croise et al. ..... 439/697

FOREIGN PATENT DOCUMENTS

| | | | |
|---|---|---|---|
| JP | H07-169523 | A | 7/1995 |
| JP | 2000-082519 | A | 3/2000 |
| JP | 2005-158728 | A | 6/2005 |
| JP | 2006-040737 | A | 2/2006 |
| JP | 2006-128032 | A | 5/2006 |
| JP | 2006-172903 | A | 6/2006 |

* cited by examiner

*Primary Examiner*—James Harvey
(74) *Attorney, Agent, or Firm*—Rader, Fishman & Grauer, PLLC

(57) ABSTRACT

A socket contact of small-size is provided for which detachment at solder from the print substrate is difficult. In the contact 1, a face in the thickness direction 120 of a front end portion of a pair of elastic arms 12*a* and 12*b* faces toward the insertion opening 21. When a blade contact 3 is inserted into an insertion opening 21, it is possible to open front end portions of a pair of elastic arms 12*a* and 12*b* in opposing directions. The configuration is such that, by providing first to third press fit fragments 111, 112, and 113 on a base unit 11, the same is securely held to the housing 2, so that only compressive stress acts on the pair of lead portions 11*c* and 11*d*, and can be made difficult to detach at solder from the print substrate 1*p*.

4 Claims, 6 Drawing Sheets

SOCKET CONTACT

This application is based on and claims the benefit of priority from Japanese Patent Application No. 2008-052871, filed on 4 Mar. 2008, the content of which is incorporated herein by reference in its entirety.

BACKGROUND OF THE INVENTION

1. Field of the Invention

The present invention relates to a socket contact. In particular, it relates to a structure of a socket contact mounted to a print substrate, in which the socket contact is constructed to be a female contact configured to couple with a male connector of a blade form.

2. Related Art

For example, it is possible to attach a plug to a terminal of an electrical wire, attach a receptacle to a print substrate, removably couple these connectors, and electrically connect the wire to the print substrate. Such a connector is referred to as a so-called "Wire to Board Connector."

Furthermore, it is possible to attach a plug to one print substrate, attach a receptacle to another print substrate, removably couple these connectors, and electrically connect the pair of print substrates. Such a connector is referred to as a so-called "Board to Board Connector."

In addition, usually, male contacts are placed in plugs and female contacts are placed in receptacles.

In recent years, along with small electronic apparatuses, plugs and receptacles have also become small. Furthermore, in connectors that connect a connector having pin contacts (male contacts) and a connector having socket contacts (female contacts) which clamp these pin contacts, socket contacts of small size which nevertheless have high clamping power and spring resistance have been invented (for example, see Japanese Unexamined Patent Application Publication No. H7-169523 (hereinafter referred to as "Patent Document 1")).

The socket contact according to Patent Document 1 forms an embossed portion that stretches along a pair of beams which are leaf spring form members, from a vicinity of a region of contact to a fixed end. Furthermore, a depth D2 of the embossed portion is made deepest in a vicinity of the fixed end, and a depth D1 of the embossed portion is gradually made shallower as the same extends along the top of the region of contact, or the fixed end.

The socket contact according to Patent Document 1 is described as made to be able to raise a second moment area of the vicinity of the fixed end of the beams in achieving spring strength. Furthermore, the socket contact according to Patent Document 1 is described as lessening the second moment of area toward the fixed end or the region of contact, and being able to avoid convergence of stress and to disperse the same.

The socket contact according to Patent Document 1 provides a terminal extending in a direction orthogonal to an insertion direction of pin contacts on a fixed end of one of the beams. In addition, this terminal is inserted into a through hole provided on the print substrate, and soldered. That is to say, the connector having a socket contact according to Patent Document 1 achieves a print substrate connector.

Incidentally, for this kind of print substrate connector, SMT (Surface Mount Technology), in which a lead portion of a contact is joined by soldering to a print substrate, is becoming common in replacing through hole mounting.

In SMT, because there is no need to provide through holes in the print substrate, it is possible to narrow a central pattern clearance, and to equip electronic components having leads of a narrow pitch. Moreover, SMT has a merit in that double-sided mounting is made possible, and thus can increase mounting density.

However, if the terminal of the socket contact according to Patent Document 1 is converted to a lead for SMT, when the pin contacts are inserted, there is the problem in that a force acts to strip the lead from the print substrate by a bending moment acting thereon.

Furthermore, there is the problem in that, when a blade-shaped male contact instead of a pin contact is inserted into a pair of beams, since the friction resistance increases greater than with the pin contacts, a bending moment acting on the lead increases, and the force stripping the same from the print substrate increases still further.

That is to say, a small-size socket contact that surface mounts to a print substrate is sought such that, even if a blade-shaped male contact (hereinafter called a "blade contact") is inserted therein, detaching at solder of the small-size socket contact from the print substrate is difficult. The above can be said to be the topic of the present invention.

SUMMARY OF THE INVENTION

The present invention was made in view of the above-mentioned issue, with the objective thereof being to provide a small-size socket contact, in which a blade contact is inserted into the socket contact, for which detaching at solder from the print substrate is difficult.

The inventors of the present invention discovered that, by solidly mounting a socket contact into a housing such that the same has a pair of strip-shaped elastic arms in which the front end portions apply contact force in opposite facing directions, such that the blade contacts are inserted into the socket contact from a direction orthogonal to directions in which the front end portions of these elastic arms opens and closes, the lead portions thereof make detaching at solder from the print substrate difficult, and thus arrived at inventing the hereinafter such new socket contact.

According to a first aspect, a socket contact is incorporated into a housing of a substantially rectangular body installed on a print substrate. The housing has a first face provided with an insertion opening in which a tabular opposing contact is inserted toward the print substrate, a second face adjacent to the first face of the housing, and a compartment that is open to the second face and in communication with the insertion opening. The socket contact includes: a base portion formed in a U-shaped strip held in the compartment, and a pair of elastic arms having strip-shaped front end portions each extending from one of the end portions of the base portion and clamping the opposing contact, in which the base portion includes a top panel portion formed in a substantially rectangular tabular shape; a pair of strip fragments in which both wings of the top panel portion are curved and extend substantially planarly in a direction orthogonal to an extending direction in which the pair of elastic arms extend; and a pair of lead portions solderable to the print substrate, extending portions of the strip fragments being curved and each extending in an opposite direction from each other. The top panel portion includes a first press fit fragment, extending in substantially the same direction as an extending direction of the pair of elastic arms, that is press fitted to an inner wall of the compartment. The pair of lead portions includes a second press fit fragment and a third press fit fragment, extending in a direction substantially identical to an extending direction of the pair of elastic arms, that are press fitted to an inner wall of the compartment. The front end portions of the pair of elastic arms have a face in the thickness direction thereof that faces toward the insertion opening, and when the opposing contact is inserted into the insertion opening, the front end portions of the pair of elastic arms open in opposite directions.

The socket contact according to the first aspect of the invention is installed into a substantially rectangular solid housing. The housing is placed on a print substrate. Moreover, the housing is installed on a first face of an insertion opening. In the insertion opening, a tabular opposing contact is inserted facing toward the print substrate.

Moreover, the socket contact according to the first aspect of the invention includes a base portion formed in a U-shaped strip and a pair of elastic arms. The base portion is held in a compartment. The compartment is open to a second face adjacent to a first face of the housing, and is in communication with the insertion opening. The pair of elastic arms extends from one end portion of the base portion, and strip-shaped front end portions together clamp the opposing contact therewith.

In addition, in the socket contact according to the first aspect of the invention, the base portion has a top panel portion, a pair of strip fragments, and a pair of lead portions. The top panel portion is formed in a substantially rectangular tabular shape. For the pair of strip fragments, both wings of the top panel portion are curved, and extend substantially parallel in a direction orthogonal to a direction in which the pair of elastic arms extends. For the pair of lead portions, the extending portions of the strip fragments are curved and extend opposing each other, and are solderable to the print substrate.

Furthermore, in the socket contact according to the first aspect of the invention, the top panel portion has a first press fit fragment. In the first press fit fragment, a pair of elastic arms extends in the same direction to a direction in which the pair of elastic arms extends, and is press fitted to an inner wall of the compartment. Moreover, the pair of lead portions has a second press fit fragment and a third press fit fragment. The second press fit fragment and third press fit fragment extend in the same direction to a direction in which the pair of elastic arms extend, and are press fitted to an inner wall of the compartment.

In the socket contact according to the first aspect of the invention, when a face in the thickness direction of the front end portions of the pair of elastic arms faces toward the insertion opening, and the opposing contact is inserted into this insertion opening, it is possible for the front end portions of the pair of elastic arms to open in opposite directions.

Here, the tabular opposing contact may be, for example, an output terminal supplying electricity, or may be a tab-shaped electric contact point that is a male contact in which the contact portion is slender and plate-shaped, or may be a blade contact having a rectangular cross-section with a chamfered insertion portion and does not have springiness, or may be a male tab, also called a faston tab. For the tab-shaped electric contact point, a wire may be crimped, or may be mounted on the print substrate. The blade contact can be placed on the housing.

The print substrate may be a hard rigid substrate, or a soft flexible substrate, and the socket contact is installed therein. Installing the socket contact on the print substrate includes surface mounting in which the socket contact is surface-mounted on the print substrate, and leads of the socket contact are fixed to the print substrate by reflow soldering. This Surface Mounting Technology (SMT) is suited toward automated mounting.

The flexible base plate can function as a flat flexible cable alternative to wire. This kind of flat flexible cable is called an FPC (Flexible Printed Circuit) or FFC (Flexible Flat Cable). By installing a socket contact into the flexible base plate, it is possible to achieve a so-called wire-to-wire connector and a wire-to-print substrate connector. It is possible to achieve a print substrate-to-print substrate connector by installing the socket contact into a rigid base plate.

The housing has insulation properties. Having insulation properties may indicate being composed of nonconductive materials, and it is possible for the housing to obtain a desired shape by forming synthetic resin with insulation properties.

The housing may be a hexahedron (a substantially rectangular solid), and an insertion opening formed in a substantially rectangular form matching a contour of the opposing contact is provided on a first face. In addition, a third face opposing the first face is provided abutting the print substrate.

The insertion opening may acceptably pass through the third face, and may be configured so that a front end face of the opposing contact stops upon abutting the print substrate, and may acceptably be provided on a bottom portion of the insertion opening, and may acceptably be configured such that the front end face of the opposing contact stops upon abutting this bottom portion. It is preferable for a chamfer to be formed on the perimeter of the insertion opening so that the opposing contact can be inserted easily.

The socket contact is preferably a bellows-shape contact, and may be formed by way of bending processing an expansion sheet punched out into a required shape, or a contact point which comes into contact with both faces of the opposing contact may be pre-formed at the front end portions of the pair of elastic arms by way of beads, thereby forming a pair of lead portions on the base portion. The socket contact is electrically conductive, and although an electrically-conductive metal such as a copper alloy is preferably used, is not limited to copper alloys.

The compartment may acceptably be partitioned into a first compartment holding the base portion, and a second compartment in communication with the insertion opening. The first to third press fit fragments are press fitted to an inner wall of the first compartment, and the base portion is firmly held against the housing. Barbs may be provided on the first to third press fit fragments and, by press fitting into the housing, can fix the base portion to be difficult to fall out. In the second compartment, opening and closing operations of front end portions of the pair of elastic arms are allowed.

The pair of elastic arms configure a tuning fork-shaped contact (also known as a bifurcated contact) having a so-called tuning fork shape, capable of applying contact force in directions facing each other by way of two arms. That is to say, the pair of elastic arms can clamp the opposing contact.

Furthermore, ordinarily, opposing contacts are inserted toward a base end portion from a front end portion of the tuning fork-shaped contact. That is to say, the pair of elastic arms is placed so as to stand on the print substrate. In addition, by providing lead portions on base end portions of this pair of elastic arms, only compressive stress acts on lead portions at a time of insertion of the opposing contact, so the lead portions can be made difficult to detach from solder.

However, when the pair of elastic arms are placed so as to stand on the print substrate, since the pair of elastic arms need a required length, an installation height of a connector that includes the pair of elastic arms is increased. That is to say, lowering a profile for the connector including the pair of elastic arms becomes difficult.

Therefore, the socket contact according to the first aspect of the invention has facilitated lowering a height of a connector including the pair of elastic arms, by way of inserting the tabular opposing connector from a face in the thickness direction of the front end portions of the pair of elastic arms, thereby opening the front end portions of the pair of elastic arms in opposite directions. The reason is that a width (height) of a pair of elastic arms having required contact force compared to the length thereof can be sufficiently small.

On the other hand, in the socket contact according to the first aspect of the invention, a pair of elastic arms are placed like a cantilever in the housing, and when a load operates on front end portions of the pair of elastic arms (when an opposing contact is inserted), a bending moment acts on lead portions provided on the base portion. Therefore, the socket contact according to the first invention is configured so that first to third press fit fragments are provided, securely holding the base portion to the housing.

In this manner, in the socket contact according to the first aspect of the invention, when the opposing contact is inserted, the socket contact and the housing become integrated and urge the print substrate, so that only compressive stress acts on the pair of lead portions, and are made difficult to be detached from solder.

According to a second aspect of the socket contact as described in the first aspect of the invention, front end portions of the pair of elastic arms have a pair of curved guiding fragments into which the opposing contact can be easily inserted and open toward the insertion opening.

The front end portions of the pair of elastic arms may open toward the insertion opening, and have a pair of curved guiding fragments in which the opposing contact can be easily inserted.

According to a third aspect, a connector includes the socket contact as described in the first or second aspect of the invention.

The socket contact according to the present invention has a pair of strip-shaped elastic arms in which the front end portions together apply contact force in opposing directions, and the socket contact is securely incorporated into the housing in such a way that a blade contact is inserted from a direction orthogonal to an opening and closing direction of these elastic arms, so that it is difficult for the lead portions thereof and the print substrate to detach from solder.

DETAILED DESCRIPTION OF THE INVENTION

Hereinafter, a preferred embodiment of the present invention is explained.

Figure 1:
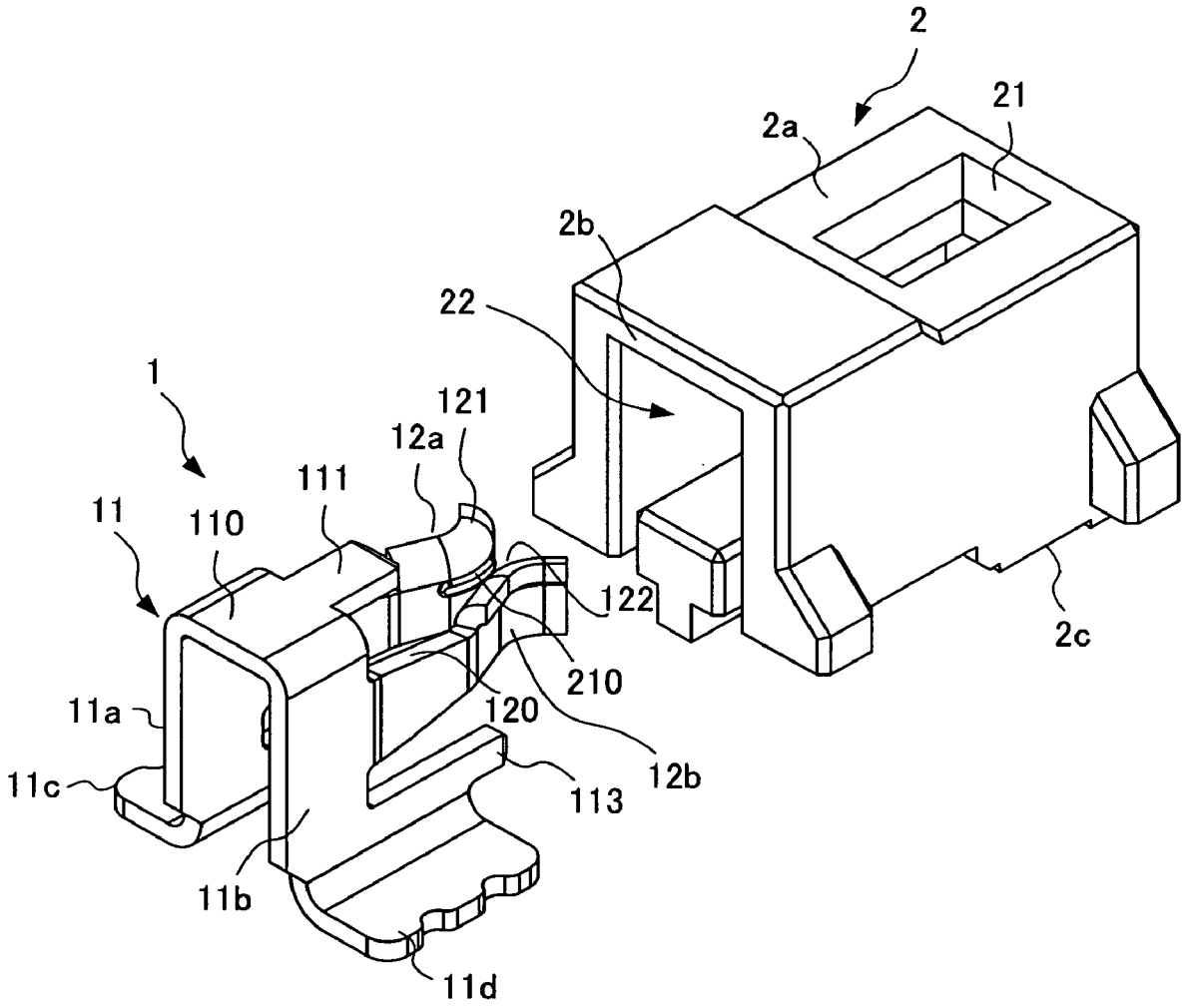
FIG. 1 is an external perspective view showing a first embodiment of a socket contact according to the present invention, in which a housing to be installed is placed.
Figure 2:
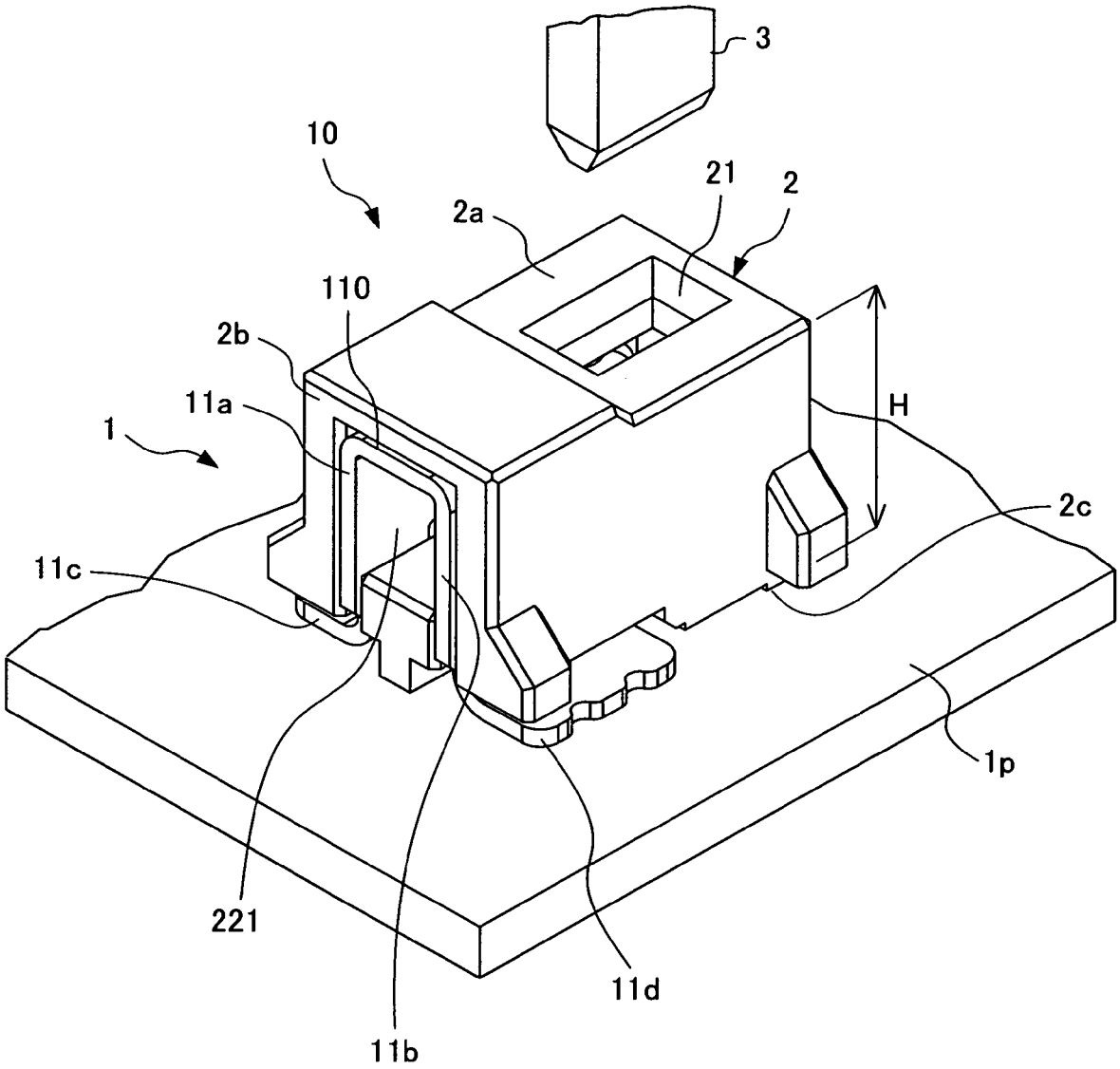
FIG. 2 is an external perspective view of a connector including the socket contact of the embodiment.
Figure 3:
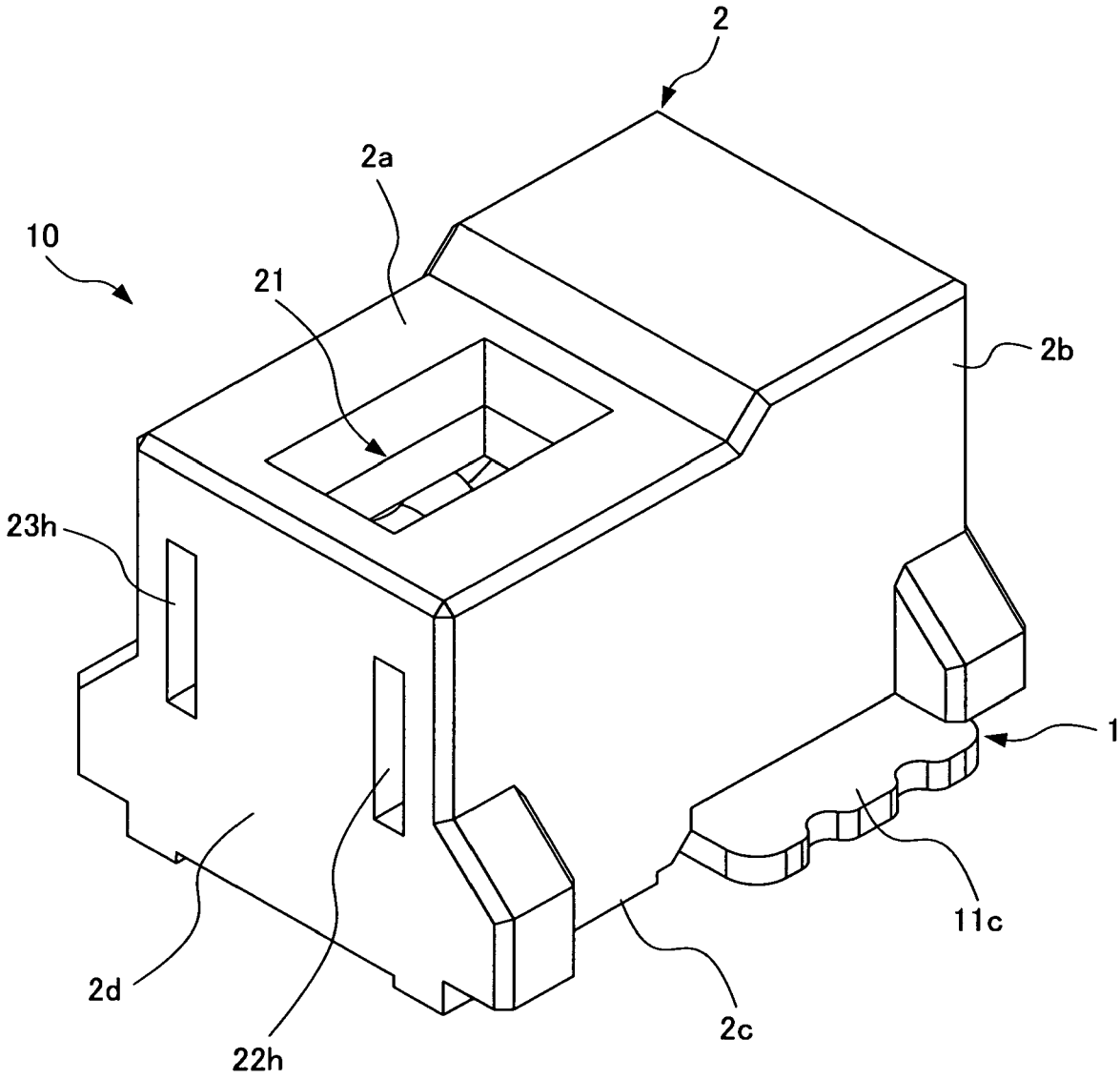
FIG. 3 is an external perspective view of a connector including the socket contact of the embodiment, in which the connector is seen from a different direction than that of FIG. 2.

FIG. 1 is an external perspective view showing a first embodiment of a socket contact (hereinafter abbreviated as "contact") according to the present invention, in which a housing to be installed is placed. FIG. 2 is an external perspective view of a connector including the contact of the embodiment. FIG. 3 is an external perspective view of a connector including the contact of the embodiment, in which the connector is seen from a different direction than that of FIG. 2.

Figure 4:
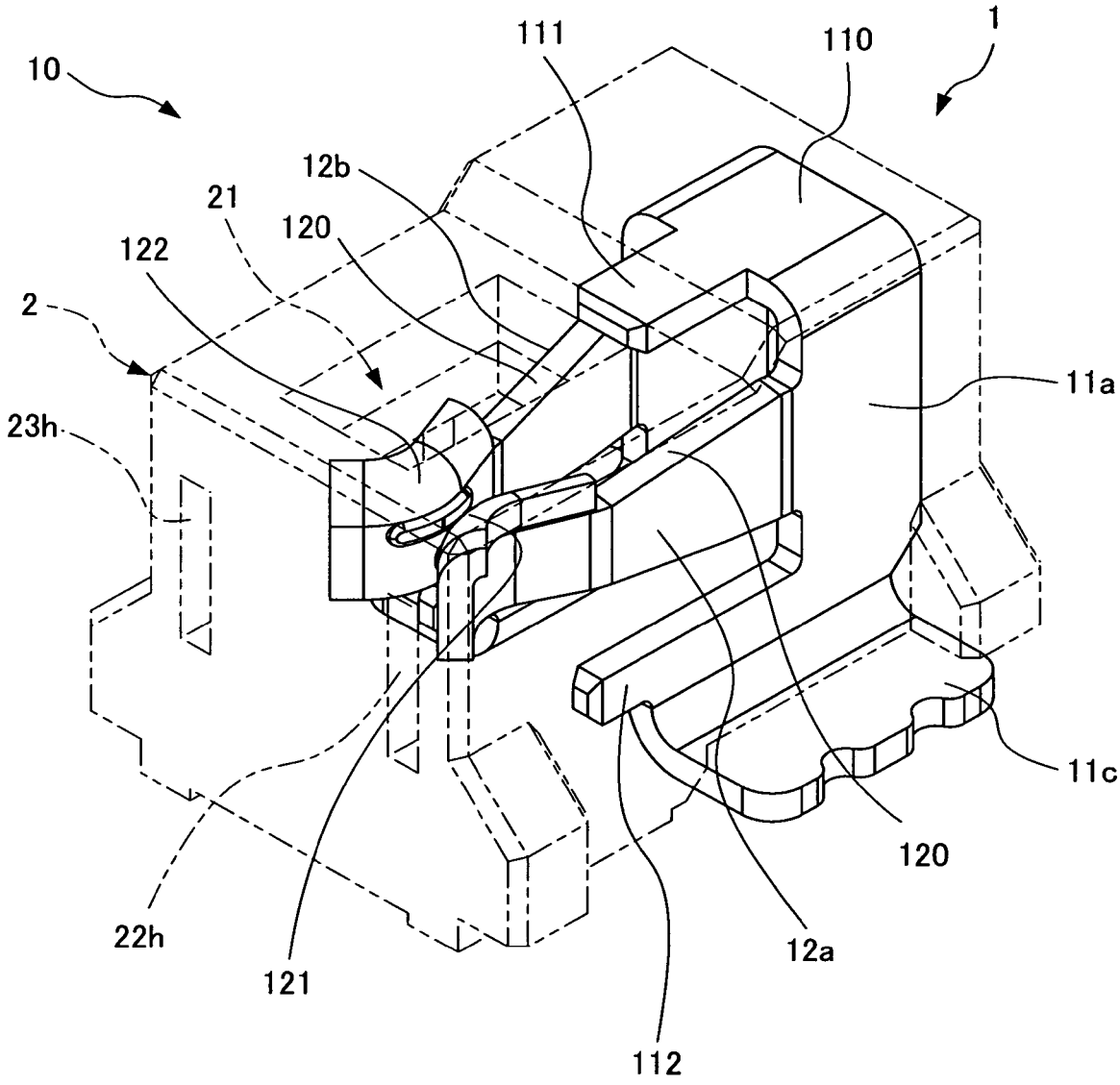
FIG. 4 is an external perspective view of the socket contact of the embodiment, showing the installed housing with imaginary lines.
Figure 5:
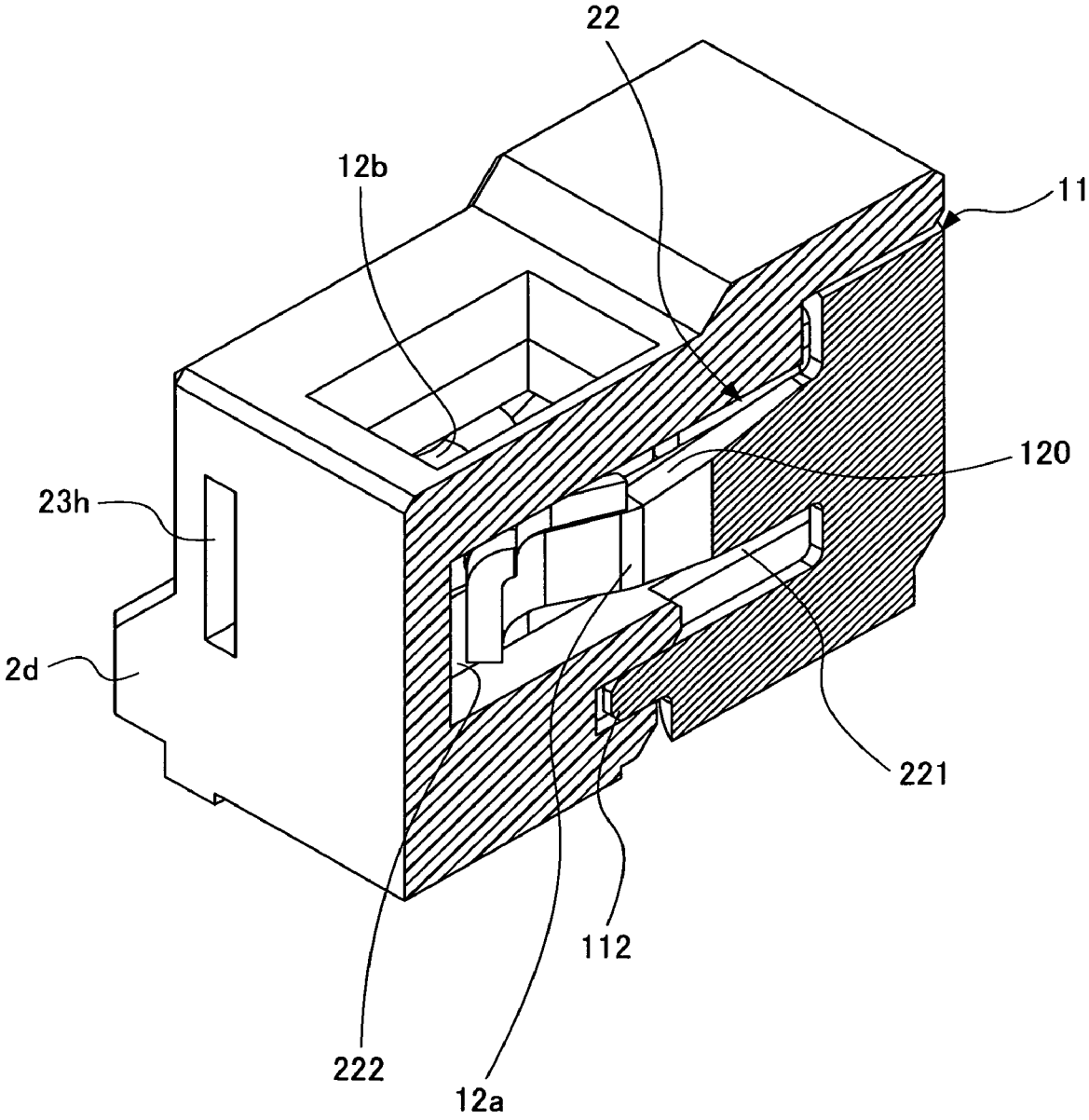
FIG. 5 is a vertical cross-sectional view of a connector including the socket contact of the embodiment, having a second press fit fragment included with the socket contact in cross-section.
Figure 6:
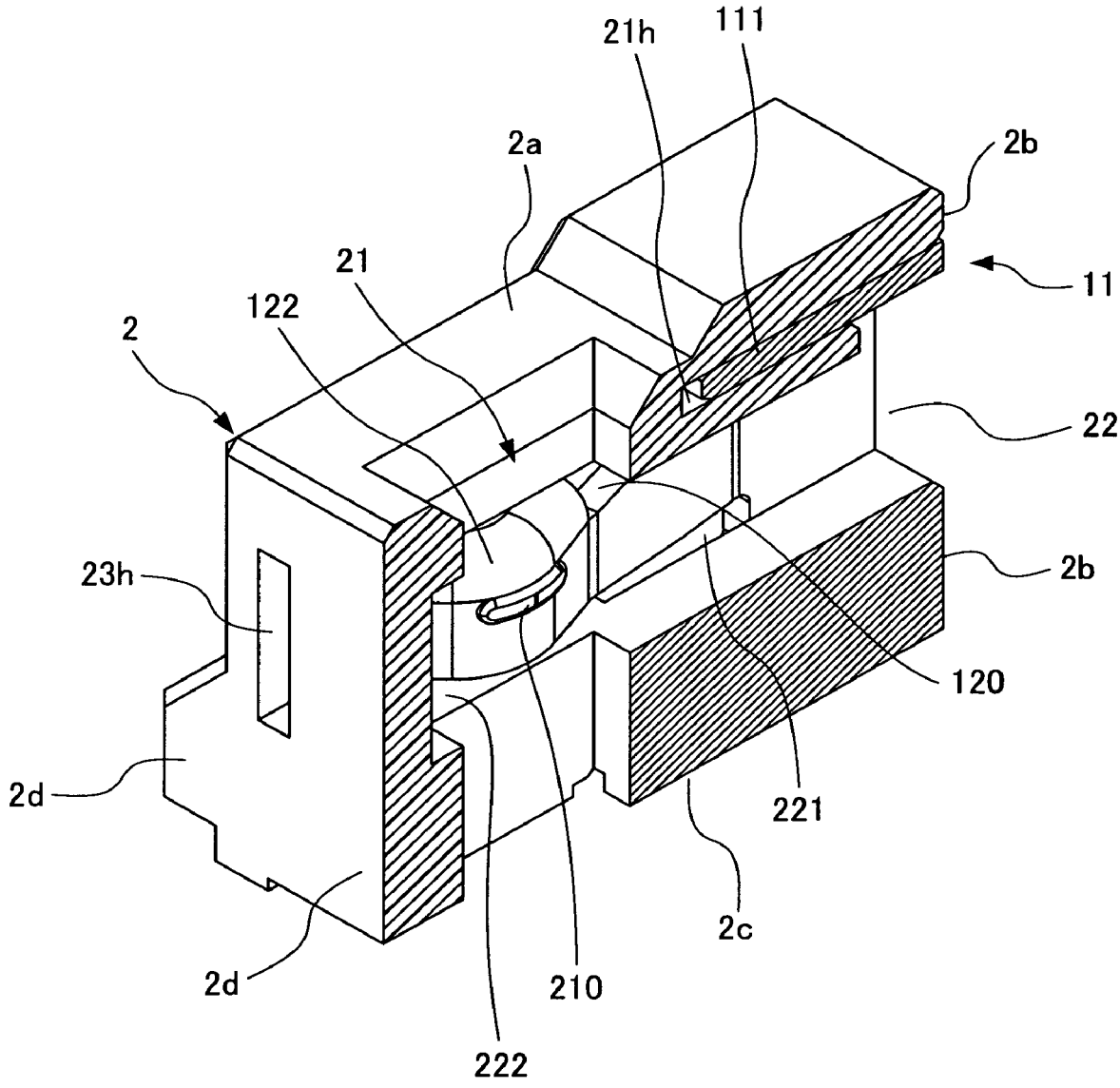
FIG. 6 is a vertical cross-sectional view of a connector including the socket contact of the embodiment, having a top panel portion included with the socket contact in cross-section.

FIG. 4 is an external perspective view of the contact of the embodiment, showing the installed housing with imaginary lines. FIG. 5 is a vertical cross-sectional view of a connector including the contact of the embodiment, having a second press fit fragment included with the contact in cross-section. FIG. 6 is a vertical cross-sectional view of a connector including the contact of the embodiment, having a top panel portion included with the contact in cross-section.

First, a configuration of the contact according to the present invention is explained. In FIG. 1, contact 1 is installed into a housing 2 of a generally rectangular solid. Housing 2 is installed into a print substrate 1*p* (see FIG. 2). Moreover, housing 2 has an insertion opening 21 provided on a first face 2*a*. In the insertion opening 21, a tabular opposing contact (hereinafter called a "blade contact") 3 is inserted toward the print substrate 1*p* (see FIG. 2).

In FIG. 1, the contact 1 includes a base portion 11 formed of a U-shaped strip and a pair of elastic arms 12*a* and 12*b*. The base portion 11 is held in a compartment 22 of the housing 2. The compartment 22 is open on a second face 2*b* adjacent to a first face 2*a* of the housing 2, and is in communication with the insertion opening 21 (see FIG. 6). The pair of elastic arms 12*a* and 12*b* extend from one end portion of the base portion 11, and strip-shaped front end portions together clamp the blade contact 3 (see FIG. 2).

In FIG. 1, the base portion 11 of contact 1 has a top portion 110, a pair of strip fragments 11*a* and 11*b*, and a pair of lead portions 11*c* and 11*d*. The top portion 110 is formed in a generally rectangular tabular shape. The pair of strip fragments 11*a* and 11*b* is curved in both wings of their top portion 110, and extends substantially parallel in a direction orthogonal to an extending direction of the pair of elastic arms 12*a* and 12*b*. For the pair of lead portions 11*c* and 11*d*, the extending portions of the strip fragments are curved and extend in directions opposing each other, and are solderable to the print substrate 1*p* (see FIG. 2).

In FIG. 1, the top portion 110 has a first press fit fragment 111. The first press fit fragment 111 extends in the same direction to an extending direction of the pair of elastic arms 12*a* and 12*b*, and are press fitted to an inner wall of the compartment 22 (see FIG. 6). Moreover, the pair of lead portions 11*c* and 11*d* has a second press fit fragment 112 (see FIG. 5) and a third press fit fragment 113. The second press fit fragment 112 and the third press fit fragment 113 extend in the same direction to an extending direction of the pair of elastic arms 12*a* and 12*b*, and are press fitted to an inner wall of the compartment 22 (see FIG. 5).

In FIG. 4, a face in the thickness direction 120 of the front end portions of the pair of elastic arms 12*a* and 12*b* of the contact 1 faces toward an insertion opening 21. In addition, when the blade contact 3 is inserted into the insertion opening 21, it is possible to open the front end portions of the pair of elastic arms 12*a* and 12*b* in opposing directions.

Moreover, in FIGS. 1 and 4, the front end portions of the pair of elastic arms 12*a* and 12*b* have a pair of curved guiding fragments 121 and 122 that open toward the insertion opening 21. Therefore, insertion of the blade contact 3 is easy (see FIG. 2).

In FIGS. 2 and 3, by way of incorporating the contact 1 into the housing 2, a connector 10 that can be installed onto a surface on the print substrate 1*p* is configured. In addition, it is possible to achieve a wire-to-print substrate connector, or a print substrate-to-print substrate connector.

In FIGS. 1 to 3, the housing 2 is formed into a hexahedron (a substantially rectangular solid). In addition, an insertion opening 21 formed in a substantially rectangular form matching a contour of an exterior of the blade contact 3 is provided on a first face 2*a*. Furthermore, a third face 2*c* opposing the first face 2*a* is provided abutting the print substrate 1*p*.

As shown in FIG. 6, the insertion opening 21 passes through the third face 2*c*. When the blade contact 3 is inserted into the insertion opening 21, it is possible for a front end portion of the blade contact 3 to stop upon abutting the print substrate 1*p* (see FIG. 2). Moreover, in the housing 2, in order for the blade contact 3 to be inserted easily, a chamfer is formed on the perimeter of the insertion opening 21 (see FIG. 2).

In FIGS. 1 to 3, the contact 1 is formed of an expansion sheet (not shown) punched out into a required shape by way of bending processing. Furthermore, a contact point where front end portions of the pair of elastic arms 12*a* and 12*b* come into contact with both faces of the blade contact 3 is formed with bead preliminary. Moreover, a pair of lead portions 11*c* and 11*d* is formed on the base portion 11.

As shown in FIGS. 5 and 6, the compartment 22 is partitioned into a first compartment 221 holding the base portion 11, and a second compartment 222 in communication with the insertion opening 21. Furthermore, in the housing 2, a first hole 21*h* into which a first press fit fragment 111 is press fitted is open to a second face 2*b* (see FIG. 6). Moreover, in the housing 2, a pair of a second hole 22*h* and a second hole 23*h*, into which a second press fit fragment 112 and a third press fit fragment 113 are press fitted, respectively, are open to the second face 2*b* (see FIG. 4). In addition, the second hole 22*h* and the third hole 23*h* pass through a fourth face 2*d* of the housing 2 (see FIG. 3).

In the first to third press fit fragments 111, 112, and 113, barbs may be provided, and can be press fitted into the housing 2 so that the base portion 11 is fixed so as to be difficult to fall out thereof. In the second compartment 222, opening and closing operations of front end portions of the pair of elastic arms 12*a* and 12*b* are allowed (see FIG. 4).

Next, operation of a contact according to the present invention is explained. In FIG. 1 or 4, the pair of elastic arms 12*a* and 12*b* configures tuning fork contacts capable of applying contact force in directions facing each other. That is to say, the pair of elastic arms 12*a* and 12*b* is capable of clamping opposing contacts within a range of an elastic limit.

As disclosed in Patent Document 1, ordinarily, the opposing contact is inserted from the front end portion of the tuning fork contact toward the base end portion. That is to say, the pair of elastic arms 12*a* and 12*b* is placed so as to stand on the print substrate 1*p*. Furthermore, if a lead portion is provided on a base end portion of the pair of elastic arms 12*a* and 12*b*, only compressive stress acts on the lead portions at a time of insertion of the opposing contact, so that these lead portions are made to be difficult to detach from solder.

However, in FIG. 2, when the pair of elastic arms 12*a* and 12*b* is placed so as to stand on the print substrate 1*p*, since the pair of elastic arms 12*a* and 12*b* needs a required length, a mounting height H of the connector 10 including the pair of elastic arms 12*a* and 12*b* is increased. That is to say, lowering a profile of the connector 10 including the pair of elastic arms 12*a* and 12*b* becomes difficult.

Therefore, by inserting the blade contact 3 from the face in the thickness direction 120 of the front end portion of the pair of elastic arms 12*a* and 12*b*, the contact 1 according to the present invention opens the front end portions of the pair of elastic arms 12*a* and 12*b* in opposite directions, and thus has facilitated lowering the profile of the connector 10 including the pair of elastic arms 12*a* and 12*b*. The reason is that the pair of elastic arms 12*a* and 12*b* having required contact force can be sufficiently small in their width (height) in comparison to length.

On the other hand, in FIG. 4, the contact 1 according to the present invention has the pair of elastic arms 12*a* and 12*b* which is placed like a cantilever in the housing 2. Furthermore, when a load acts on front end portions of the pair of elastic arms 12*a* and 12*b* (when a blade contact 3 is inserted), a bending moment acts on lead portions 11*c* and 11*d* provided on the base portion 11. Therefore, the contact 1 according to the present invention is made into a configuration securely holding to the housing 2, by providing first to third press fit fragments 111, 112, and 113.

In this manner, in FIG. 2, in the contact 1 according to the present invention, when the blade contact 3 is inserted, the contact 1 and the housing 2 become integrated in urging the print substrate 1*p*, so that only compressive stress acts on the pair of lead portions 11*c* and 11*d*, and can make detachment from solder difficult.

What is claimed is:

1. A socket contact to be incorporated into a housing of a substantially rectangular body installed on a print substrate, the housing having a first face provided with an insertion opening in which a tabular opposing contact is inserted toward the print substrate;

a second face adjacent to the first face of the housing; and a compartment that is open to the second face and in communication with the insertion opening, the socket contact comprising:

a base portion formed in a U-shaped strip held in the compartment; and a pair of elastic arms having strip-shaped front end portions each extending from one of the end portions of the base portion and clamping the opposing contact, wherein:

the base portion includes:

a top panel portion formed in a substantially rectangular tabular shape;

a pair of strip fragments wherein both wings of the top panel portion are curved and extend substantially planarly in a direction orthogonal to an extending direction in which the pair of elastic arms extend; and a pair of lead portions solderable to the print substrate, extending portions of the strip fragments being curved and each extending in an opposite direction from each other; wherein the top panel portion includes a first press fit fragment, extending in substantially the same direction as an extending direction of the pair of elastic arms, that is press fitted to an inner wall of the compartment, the pair of lead portions includes a second press fit fragment and a third press fit fragment, extending in a direction substantially identical to an extending direction of the pair of elastic arms, that are press fitted to an inner wall of the compartment, and the front end portions of the pair of elastic arms have a face in the thickness direction thereof that faces toward the insertion opening, and when the opposing contact is inserted into the insertion opening, the front end portions of the pair of elastic arms open in opposite directions.

2. The socket contact according to claim 1, wherein front end portions of the pair of elastic arms have a pair of curved guiding fragments into which the opposing contact can be easily inserted and open toward the insertion opening.

3. A connector comprising the socket contact according to claim 1.

4. A connector comprising the socket contact according to claim 2.

* * * * *